US007688202B1

(12) United States Patent
Doyle et al.

(10) Patent No.: US 7,688,202 B1
(45) **Date of Patent: *Mar. 30, 2010**

(54) DISTRIBUTED PERIMETER SECURITY THREAT DETERMINATION

(75) Inventors: Alan T. Doyle, Brookfield, WI (US); Alan C. Hay, Sullivan, WI (US)

(73) Assignee: Kelly Research Corp., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/399,581

(22) Filed: Apr. 6, 2006

(51) Int. Cl.
*G08B 13/00* (2006.01)

(52) U.S. Cl. ..... 340/541; 340/506; 340/5.1; 340/10.1

(58) Field of Classification Search ..... 340/541, 340/540, 545.1, 545.9, 551, 552, 553, 554, 340/561, 565, 286.01, 539.17, 506, 5.1, 10.1
See application file for complete search history.

(56) References Cited

U.S. PATENT DOCUMENTS

| | | | | |
|---|---|---|---|---|
| 4,326,272 | A | 4/1982 | Rittenbach et al. | |
| 4,365,239 | A | 12/1982 | Mongeon | |
| 4,450,434 | A | 5/1984 | Nielsen et al. | |
| 4,562,428 | A * | 12/1985 | Harman et al. | 340/552 |
| 4,609,909 | A * | 9/1986 | Miller et al. | 340/541 |
| 4,684,932 | A | 8/1987 | Kupec et al. | |
| 4,800,366 | A | 1/1989 | Hussman | |
| 4,857,912 | A | 8/1989 | Everett, Jr. et al. | |
| 6,209,395 | B1 | 4/2001 | Kristensen | |
| 6,288,640 | B1 * | 9/2001 | Gagnon | 340/539.17 |
| 6,512,478 | B1 | 1/2003 | Chien | |
| 6,621,947 | B1 | 9/2003 | Tapanes et al. | |
| 6,664,894 | B2 * | 12/2003 | Pakhomov | 340/541 |
| 6,778,469 | B1 | 8/2004 | McDonald | |
| 6,778,717 | B2 | 8/2004 | Tapanes et al. | |
| 6,816,073 | B2 | 11/2004 | Vaccaro et al. | |
| 6,937,151 | B1 | 8/2005 | Tapanes | |
| 6,956,478 | B2 | 10/2005 | Oyagi et al. | |
| 6,980,483 | B2 | 12/2005 | McDonald | |
| 7,049,952 | B2 | 5/2006 | Kulesz et al. | |
| 7,119,681 | B2 | 10/2006 | Eskildsen | |
| 7,161,483 | B2 * | 1/2007 | Chung | 340/531 |
| 2003/0198425 | A1 | 10/2003 | Tapanes et al. | |
| 2004/0071382 | A1 | 4/2004 | Rich et al. | |
| 2005/0147340 | A1 | 7/2005 | Tapanes | |

FOREIGN PATENT DOCUMENTS

| | | |
|---|---|---|
| DE | 4114293 | 11/1992 |
| GB | 2404480 | 2/2005 |
| GB | 2409085 | 6/2005 |

* cited by examiner

*Primary Examiner*—Davetta W Goins

(57) ABSTRACT

A sensor system comprises a signal sensor configured to receive a plurality of event signals for an event, a processing system coupled to the signal sensor and configured to process the plurality of event signals to determine if the event is a threat and responsive to determining that the event is a threat generate a threat message identifying the event, and an interface system coupled to the processing system and configured to transmit the threat message to a control system.

8 Claims, 4 Drawing Sheets

DISTRIBUTED PERIMETER SECURITY THREAT DETERMINATION

RELATED APPLICATIONS

Not applicable

FEDERALLY SPONSORED RESEARCH OR DEVELOPMENT

Not applicable

MICROFICHE APPENDIX

Not applicable

BACKGROUND OF THE INVENTION

1. Field of the Invention

The field of the invention relates to perimeter security networks, and in particular, to processing event signals to evaluate threat events.

2. Description of the Prior Art

Recently, many enterprises have become increasingly concerned with the issue of perimeter security. For example, military, municipal, and corporate enterprises desire to secure the perimeters of a wide variety of installations, such as airports, military bases, and corporate campuses.

Typically, perimeter security systems are arranged with multiple sensors arrayed along a boundary and in communication with a central control system. Often times, the sensors are mounted on a barrier, such a fence. In general, the sensors monitor the boundary for event signals, such as vibration and heat signals. Upon sensing an event signal, an alert signal is communicated from the sensors to a central control system.

In one example, the central control system alerts personnel to the occurrence of the event. The personnel are then tasked with investigating the event to evaluate whether or not the event is a security threat. One problem associated with this approach is that dispatching personnel to investigate non-threatening events wastes time and resources.

In a prior art solution to the problem of dispatching personnel to evaluate events, threat evaluation is performed at the central control system. In this manner, personnel will only be dispatched once an accurate threat evaluation has been performed by the central control system. However, many modern large scale perimeter security systems include thousands of sensors. In such an environment, the resources required to perform threat evaluation at a central control system and the resources required to link thousands of sensors to a central control system can be prohibitive.

SUMMARY OF THE INVENTION

An embodiment of the invention helps solve the above problems and other problems by distributing threat evaluation to the sensor systems of a perimeter security network, rather than relying upon a central control system to perform threat evaluation tasks. In this manner, the processing resources required of a central control system are reduced. In addition, the occurrence of false alarms generated by non-threat events is reduced. Furthermore, distributing threat evaluation to the sensors systems of a perimeter security system allows for improved scalability and efficiency of operation.

In an embodiment, a security system comprises a barrier, a sensor system, and a control system. The sensor system is coupled to the barrier and is configured to receive a plurality of event signals for an event, process the plurality of event signals to determine if the event is a threat, and, responsive to determining that the event is a threat, generate and transmit a threat message identifying the event. The control system is configured to receive and process the threat message to determine a response to the event.

In an embodiment, the security system further comprises a user interface system wherein the response comprises a threat notification and wherein the control system is configured to transfer the threat notification to the user interface system and wherein the user interface system is configured to display the threat notification.

In an embodiment, a first event signal of the plurality of event signals comprises an acceleration signal.

In an embodiment, a first event signal of the plurality of event signals comprises a vibration signal.

In an embodiment, a first event signal of the plurality of event signals comprises a heat signal.

In an embodiment, a method of operating a security system comprises receiving a plurality of event signals for an event into a sensor system coupled to a barrier, in the sensor system, processing the plurality of event signals to determine if the event is a threat, responsive to determining that the event is a threat generating and transmitting a threat message identifying the event from the sensor system to a control system, and in the control system, receiving and processing the threat message to determine a response to the event.

In an embodiment, a sensor system comprises a signal sensor configured to receive a plurality of event signals for an event, a processing system coupled to the signal sensor and configured to process the plurality of event signals to determine if the event is a threat and responsive to determining that the event is a threat generate a threat message identifying the event, and an interface system coupled to the processing system and configured to transmit the threat message to a control system.

In an embodiment, the control system is remote from the sensor system.

In an embodiment, a method of operating a sensor system comprises receiving a plurality of event signals for an event, processing the plurality of event signals to determine if the event is a threat, generating a threat message identifying the event responsive to determining that the event is a threat, and transmitting the threat message to a control system.

BRIEF DESCRIPTION OF THE DRAWINGS

The same reference number represents the same element on all drawings.

DETAILED DESCRIPTION OF THE PREFERRED EMBODIMENT

FIGS. 1-4 and the following description depict specific embodiments of the invention to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will appreciate that the features described below can be combined in various ways to form multiple embodiments of the invention. As a result, the invention is not limited to the specific embodiments described below, but only by the claims and their equivalents.

Configuration and Operation—FIGS. 1-4

Figure 1:
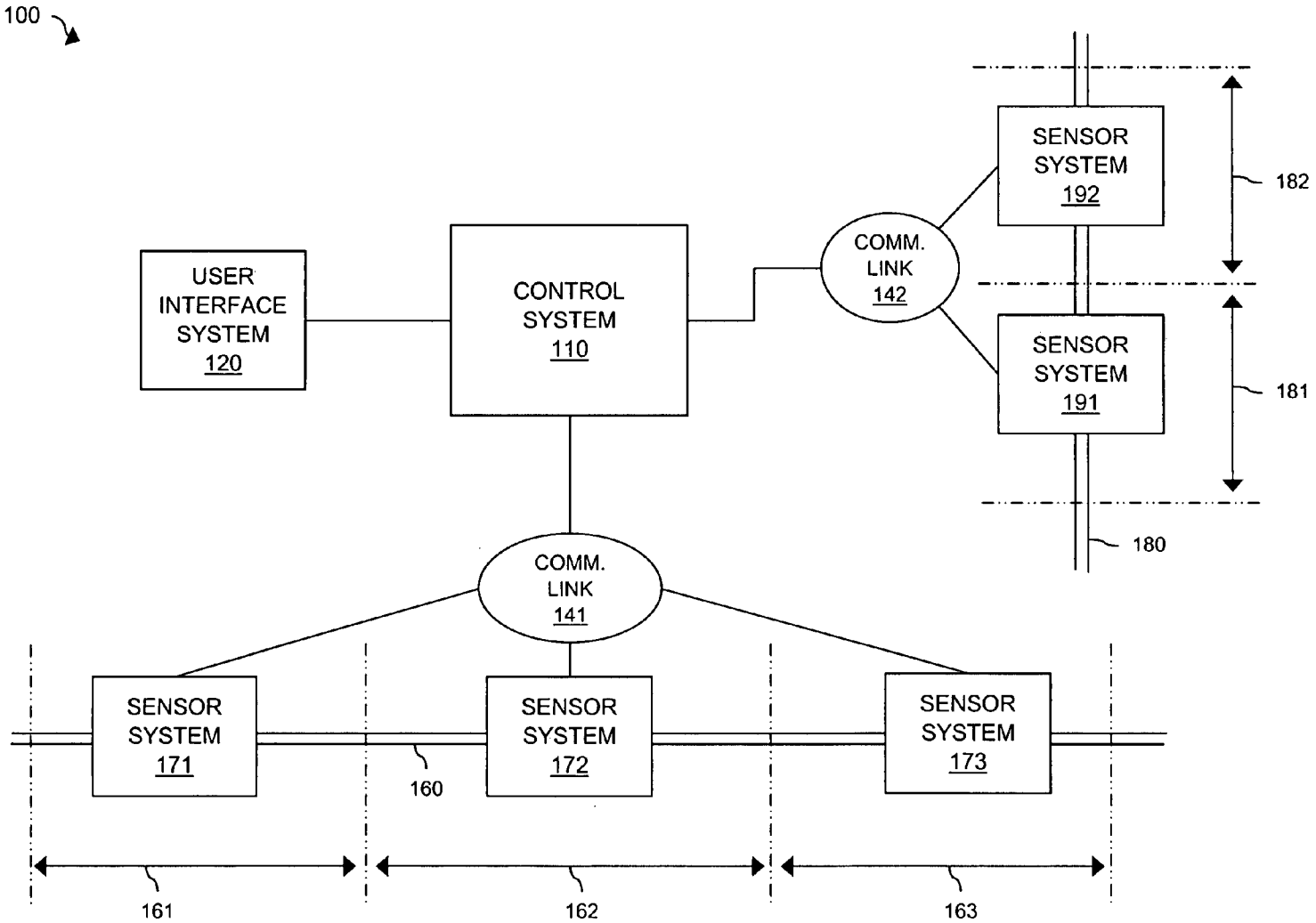
FIG. 1 illustrates a perimeter security network in an embodiment of the invention.

FIG. 1 illustrates perimeter security network 100 in an embodiment of the invention. Perimeter security network 100 includes control system 110, user interface system (UIS) 120, barrier 160, and barrier 180. Barrier 160 includes barrier segments 161, 162, and 163. Barrier 180 includes barrier segments 181 and 182. Sensor systems 171, 172, and 173 are coupled to barrier segments 161, 162, and 163 respectively. Sensor systems 191 and 192 are coupled to barrier segments 181 and 182 respectively. Sensor systems 171, 172, and 173 are in communication with control system 110 over communication link 141. Sensor systems 191 and 192 are in communication with control system 110 over communication link 142. It should be understood that, while illustrated as separate communication links, communication links 141 and 142 could comprise a single communication link.

Sensor systems 171-173 and 191-192 could be any sensor systems capable of performing remote threat evaluation of event signals generated by potential threat events. In an example, sensor systems 171-173 and 191-192 could be capable of receiving event signals for events, processing the event signals to determine whether or not the events are threats to a perimeter, and communicating with control system 110 over communication links 141 and 142 if the events are threats.

Control system 110 could be any system or collection of systems capable of communicating with sensor systems 171-173 and 191-192 and UIS 120. In an example, control system 110 could be capable of receiving threat messages from sensor systems 171-173 and 191-192 identifying threats and processing the threat messages to determine responses to the threats. For example, control system 110 could provide notification to UIS 120 of a threat, whereby UIS 120 could display the threat notification to a user. In another example, control system 110 could log threat messages for later security analysis.

UIS 120 could be any system capable of communicating with control system 110 and interfacing with a user. UIS 120 could be any type of device capable of interfacing to a user, such as a personal computer, work station, mobile work station, handheld device, phone, or pager, as well as other types of devices.

Figure 2:
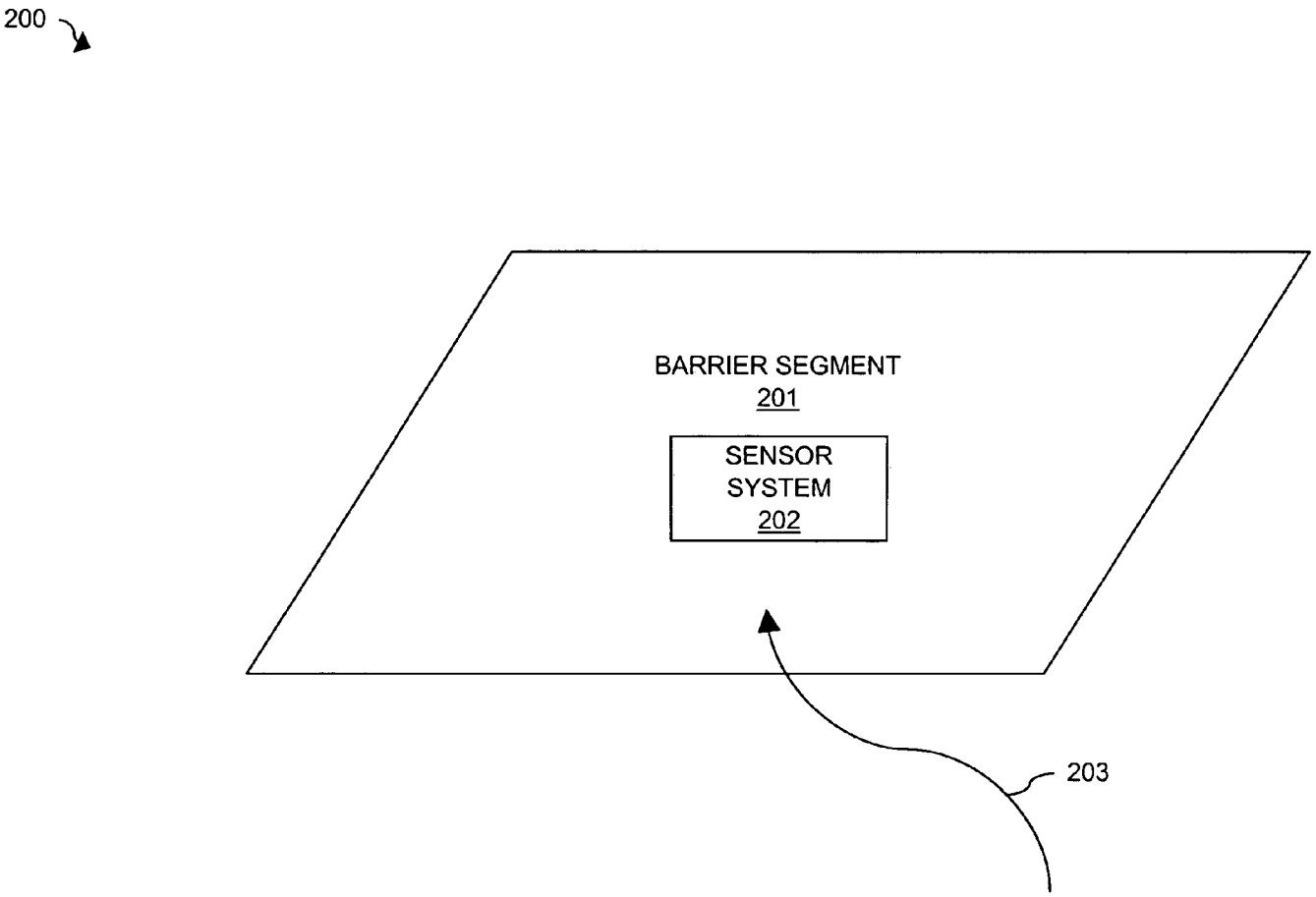
FIG. 2 illustrates a barrier system in an embodiment of the invention.

FIG. 2 illustrates barrier system 200. Barrier system 200 includes barrier segment 201, sensor system 202, and event 203 in an embodiment of the invention. Barrier segment 201 could be representative of barrier segments 161-163 and 181-182 as illustrated in FIG. 1. Sensor system 202 could be representative of sensor systems 171-173 and 191-192 as illustrated in FIG. 1.

It should be understood sensor system 202 could be coupled to barrier segment 201 in a manner well known in the art. As illustrated in FIG. 2, event 203 could cause an event signal to be generated on barrier segment 201. For example, event 203 could represent a weather force, such as wind, rain, or hail. The resulting vibration or acceleration of barrier segment 201 due to a weather force could be detectable by sensor system 202.

Figure 3:
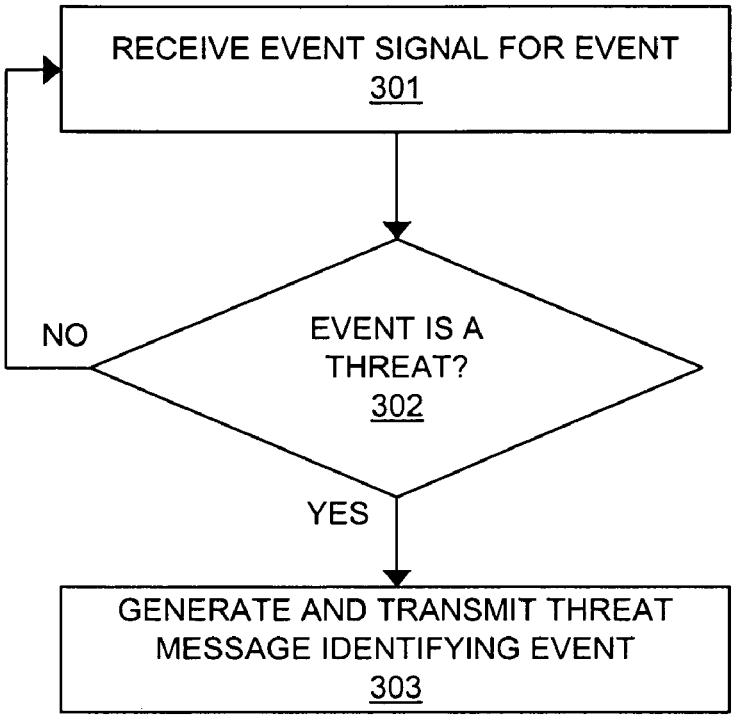
FIG. 3 illustrates the operation of a sensor system in an embodiment of the invention.

FIG. 3 illustrates a process describing the operation of sensor system 202 in an embodiment of the invention. The process illustrated in FIG. 3 could be representative of the operation of sensor systems 171-173 and 191-192. To begin, sensor system 202 receives a signal for an event (Step 301). For example, sensor system 202 could detect a vibration or acceleration in barrier segment 201. Next, sensor system 202 processes the signal to determine whether or not the event is a threat (Step 302). Upon determining that the event is a threat, sensor system 202 generates and transmits a threat message identifying the event (Step 303).

In an example, the event signal processed by sensor system 202 could indicate a pattern. It should be understood that sensor system 202 could determine whether the event is a threat based on the pattern contained in the signal. For instance, signal patterns caused by weather factors, such as wind or rain, could differ significantly from signal patterns caused by a person attempting to climb barrier segment 201. Sensor system 202 could compare, contrast, or otherwise process the event signal to discriminate between non-threat events, such as wind or rain, and threat events, such as intruders scaling a fence.

Figure 4:
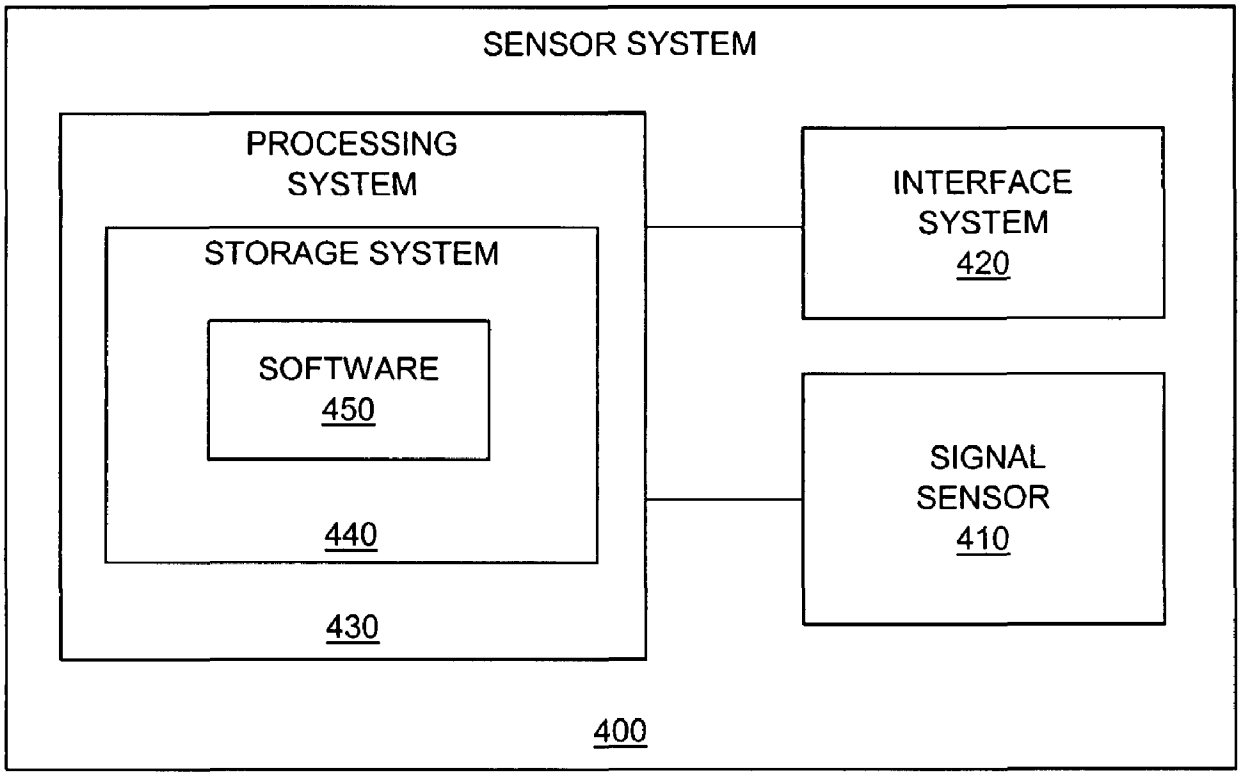
FIG. 4 illustrates a sensor system in an embodiment of the invention.

FIG. 4 illustrates sensor system 400 in an embodiment. Sensor system 400 includes signal sensor 410, interface system 420, processing system 430, storage system 440, and software 450. Storage system 440 stores software 450. Processing system 430 is linked to interface system 420. Sensor system 400 could be comprised of a programmed general-purpose computer, although those skilled in the art will appreciate that programmable or special purpose circuitry and equipment may be used.

Interface system 420 could comprise a network interface card, modem, port, or some other communication device. Processing system 430 could comprise a computer microprocessor, logic circuit, or some other processing device. Processing system 430 could be distributed among multiple processing devices. Storage system 440 could comprise a disk, integrated circuit, or some other memory device. Storage system 440 could be distributed among multiple memory devices. Signal sensor 410 could comprise any sensor capable of sensing or receiving event signals, such as an accelerometer, a vibrometer, or an infra-red sensor. It should be understood that sensor system 400 could include multiple signal sensors.

Processing system 430 retrieves and executes software 450 from storage system 440. Software 450 may comprise an operating system, utilities, drivers, networking software, and other software typically loaded onto a general-purpose computer. Software 450 could also comprise an application program, firmware, or some other form of machine-readable processing instructions. When executed by the processing system 430, software 450 directs processing system 430 to operate as described for sensor system 202 and sensor systems 171-173 and 191-192.

Perimeter Security Example

The following describes for exemplary purposes a perimeter security system and the operation thereof in an embodiment of the invention.

In this example, a perimeter security system could comprise multiple sensor systems arrayed along a perimeter, such as a border, boundary, or the like. The sensor systems could be coupled to a barrier, such a fence or a wall. For instance, the sensor systems could be mounted to a fence. Optionally, the sensor systems could be independent from a barrier, such as in the case of a video camera or infra-red sensor positioned distant from the perimeter, but directed to the perimeter. The sensor systems could be in communication with a central control system over a communication link. The communication link could be a wired or wireless communication link, or any combination thereof. An example of a wired communication link is an RS-485 link. The control system could be coupled to a user interface system, such as a work station. Personnel could monitor the user interface system for threat events occurring at the perimeter.

In operation, events will typically occur in a continuous fashion at the perimeter. For instance, in a case wherein a fence is positioned along a perimeter, weather, animal, or other environmental events will cause disturbances along the fence. For example, wind gusts could cause a disturbance to the fence. Likewise, small animals could disturb the fence, such as in the case of birds or other small animals climbing or resting on the fence. Such environmental events could be considered non-threat events.

Further in operation, events could occur that are not in accordance with non-threat events. Such non-environmental events could be considered threat events. For example, an intruder could attempt to enter the perimeter, such as by climbing a fence. In another example, an intruder could attempt to cut a fence.

Regardless of the type of event, a sensor system could detect, sense, measure, or otherwise receive signals created by an event. For example, disturbances translated to a fence by a threat or non-threat event could be measured in terms of vibration or acceleration, as well as by other factors.

In the prior art, a sensor system could transmit data corresponding to the event signals to a central control system for threat evaluation. In contrast, the present embodiment provides for evaluating data corresponding to the event signals at the sensor system. Upon receiving an event signal, the signal is converted to data in a digital form. The data is processed in the sensor system to determine whether the data contains a pattern consistent with non-threat environmental factors, such as wind, or consistent with threats, such as an intruder scaling a fence.

The evaluation result can then be provided to the central control system. The central control system can further provide the result to the user interface system. It should be understood that the central control system could optionally be combined with the user interface system in a single system.

Advantageously, embodiments of the invention provide for distributing threat evaluation to the sensor systems of a perimeter security network. In an advantage, the processing resources required of a central control system are reduced. In addition, the time and effort required of personnel for non-threat events is reduced. In yet another advantage, distributing threat evaluation to the sensors systems of a perimeter security system allows for improved scalability and efficiency of operation.

The invention claimed is:

1. A security system comprising:

a barrier;

a sensor system mounted on a segment of the barrier and configured to receive an acceleration signal for an event, process an acceleration pattern contained in the acceleration signal to determine if the event is a threat, responsive to determining that the event is a threat generate and transmit a threat message identifying the event; and a control system coupled to the sensor system by a communication link and configured to receive and process the threat message to determine a response to the event.

2. The security system of claim 1 further comprising a user interface system and wherein the response comprises a threat notification and wherein the control system is configured to transfer the threat notification to the user interface system and wherein the user interface system is configured to display the threat notification.

3. A method of operating a security system, the method comprising:

receiving an acceleration signal for an event into a sensor system coupled to a barrier;

in the sensor system, processing an acceleration pattern contained in the acceleration signal to determine if the event is a threat;

responsive to determining that the event is a threat generating and transmitting a threat message identifying the event from the sensor system to a control system; and in the control system receiving and processing the threat message to determine a response to the event.

4. The method of claim 3 wherein the response comprises a threat notification and wherein the method further comprises transferring the threat notification from the control system to a user interface system and displaying the threat notification at the user interface system.

5. A sensor system comprising:

a signal sensor configured to receive an acceleration signal for an event;

a processing system coupled to the signal sensor and configured to process an acceleration pattern contained in the acceleration signal to determine if the event is a threat and responsive to determining that the event is a threat generate a threat message identifying the event; and an interface system coupled to the processing system and configured to transmit the threat message to a control system.

6. The sensor system of claim 5 wherein the control system is remote from the sensor system.

7. A method of operating a sensor system comprising:

receiving an acceleration signal for an event;

processing an acceleration pattern contained in the acceleration signal to determine if the event is a threat;

generating a threat message identifying the event responsive to determining that the event is a threat; and transmitting the threat message to a control system.

8. The method of claim 7 wherein the control system is remote from the sensor system.

* * * * *